US007497279B2

(12) United States Patent
Hall et al.

(10) Patent No.: US 7,497,279 B2
(45) Date of Patent: Mar. 3, 2009

(54) JACK ELEMENT ADAPTED TO ROTATE INDEPENDENT OF A DRILL BIT

(76) Inventors: David R. Hall, 2185 South Larsen Pkwy., Provo, UT (US) 84606; Jim Shumway, 2185 South Larsen Pkwy., Provo, UT (US) 84606

( * ) Notice: Subject to any disclaimer, the term of this patent is extended or adjusted under 35 U.S.C. 154(b) by 102 days.

(21) Appl. No.: 11/668,341

(22) Filed: Jan. 29, 2007

(65) Prior Publication Data

US 2007/0119630 A1 May 31, 2007

Related U.S. Application Data

(63) Continuation-in-part of application No. 11/611,310, filed on Dec. 15, 2006, and a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, and a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(51) Int. Cl.
*E21B 7/06* (2006.01)

(52) U.S. Cl. ..... 175/73; 175/104; 175/106; 175/107

(58) Field of Classification Search ..... 175/104, 175/106, 107, 73, 385
See application file for complete search history.

(56) References Cited

U.S. PATENT DOCUMENTS

| | | | | |
|---|---|---|---|---|
| 465,103 | A | 12/1891 | Wegner | |
| 616,118 | A | 12/1898 | Kunhe | |
| 946,060 | A | 1/1910 | Looker | |
| 1,116,154 | A | 11/1914 | Stowers | |
| 1,183,630 | A | 5/1916 | Bryson | |
| 1,189,560 | A | 7/1916 | Gondos | |
| 1,360,908 | A | 11/1920 | Everson | |
| 1,387,733 | A | 8/1921 | Midgett | |
| 1,460,671 | A | 7/1923 | Hebsacker | |
| 1,544,757 | A | 7/1925 | Hufford | |
| 1,821,474 | A | 9/1931 | Mercer | |
| 1,879,177 | A | 9/1932 | Gault | |
| 2,054,255 | A * | 9/1936 | Howard | 175/298 |
| 2,064,255 | A | 12/1936 | Garfield | |
| 2,169,223 | A | 8/1939 | Christian | |
| 2,218,130 | A | 10/1940 | Court | |

(Continued)

*Primary Examiner*—Hoang Dang
(74) *Attorney, Agent, or Firm*—Tyson J. Wilde

(57) ABSTRACT

In one aspect of the present invention a downhole tool string has a rotor secured within a bore and connected to a jack element that is substantially coaxial with the rotor. A portion of the jack element extends out of an opening formed in a working face of a drill bit located at the bottom of the drill string. The jack element is adapted to rotate independent of the drill bit when the rotor and drill bit are in operation.

19 Claims, 7 Drawing Sheets

U.S. PATENT DOCUMENTS 2,320,136 A 5/1943 Kammerer
2,466,991 A 4/1949 Kammerer
2,540,464 A 2/1951 Stokes
2,544,036 A 3/1951 Kammerer
2,755,071 A 7/1956 Kammerer
2,776,819 A 1/1957 Brown
2,819,043 A 1/1958 Henderson
2,838,284 A 6/1958 Austin
2,894,722 A 7/1959 Buttolph
2,901,223 A 8/1959 Scott
2,963,102 A 12/1960 Smith
3,135,341 A 6/1964 Ritter
3,294,186 A 12/1966 Buell
3,301,339 A 1/1967 Pennebaker
3,379,264 A 4/1968 Cox
3,429,390 A 2/1969 Bennett
3,493,165 A 2/1970 Schonfeld
3,583,504 A 6/1971 Aalund
3,764,493 A 10/1973 Rosar
3,807,512 A * 4/1974 Pogonowski et al. ..... 175/106
3,821,993 A 7/1974 Kniff
3,955,635 A 5/1976 Skidmore
3,960,223 A 6/1976 Kleine
3,989,114 A * 11/1976 Tschirky et al. ..... 175/107
4,081,042 A 3/1978 Johnson
4,096,917 A 6/1978 Harris
4,106,577 A 8/1978 Summer
4,176,723 A 12/1979 Arceneaux
4,253,533 A 3/1981 Baker
4,280,573 A 7/1981 Sudnishnikov
4,304,312 A 12/1981 Larsson
4,307,786 A 12/1981 Evans
4,397,361 A 8/1983 Langford
4,416,339 A 11/1983 Baker
4,445,580 A 5/1984 Sahley
4,448,269 A 5/1984 Ishikawa
4,499,795 A 2/1985 Radtke
4,531,592 A 7/1985 Hayatdavoudi
4,535,853 A 8/1985 Ippolito
4,538,691 A 9/1985 Dennis
4,566,545 A 1/1986 Story
4,574,895 A 3/1986 Dolezal
4,640,374 A 2/1987 Dennis
4,732,226 A * 3/1988 Ebeling et al. ..... 175/94
4,852,672 A 8/1989 Behrens
4,875,531 A * 10/1989 Biehl et al. ..... 175/250
4,889,017 A 12/1989 Fuller
4,962,822 A 10/1990 Pascale
4,981,184 A 1/1991 Knowlton
5,009,273 A 4/1991 Grabinski
5,027,914 A 7/1991 Wilson
5,038,873 A 8/1991 Jurgens
5,119,892 A 6/1992 Clegg
5,141,063 A 8/1992 Quesenbury
5,186,268 A 2/1993 Clegg
5,193,628 A * 3/1993 Hill et al. ..... 175/45
5,222,566 A 6/1993 Taylor
5,255,749 A 10/1993 Bumpurs
5,265,682 A 11/1993 Russell
5,361,859 A 11/1994 Tibbitts
5,410,303 A 4/1995 Comeau
5,417,292 A 5/1995 Polakoff
5,423,389 A 6/1995 Warren
5,507,357 A 4/1996 Hult
5,560,440 A 10/1996 Tibbitts
5,568,838 A 10/1996 Struthers
5,655,614 A 8/1997 Azar
5,678,644 A 10/1997 Fielder
5,732,784 A 3/1998 Nelson
5,794,728 A 8/1998 Palmberg
5,896,938 A 4/1999 Moeny
5,947,215 A 9/1999 Lundell
5,950,743 A 9/1999 Cox
5,957,223 A 9/1999 Doster
5,957,225 A 9/1999 Sinor
5,967,247 A 10/1999 Pessier
5,979,571 A 11/1999 Scott
5,992,547 A 11/1999 Caraway
5,992,548 A 11/1999 Silva
6,021,859 A 2/2000 Tibbitts
6,039,131 A 3/2000 Beaton
6,131,675 A 10/2000 Anderson
6,150,822 A 11/2000 Hong
6,186,251 B1 2/2001 Butcher
6,202,761 B1 3/2001 Forney
6,213,226 B1 4/2001 Eppink
6,223,824 B1 5/2001 Moyes
6,269,893 B1 8/2001 Beaton
6,296,069 B1 10/2001 Lamine et al.
6,340,064 B2 1/2002 Fielder
6,364,034 B1 4/2002 Schoeffler
6,394,200 B1 5/2002 Watson
6,439,326 B1 8/2002 Huang
6,474,425 B1 11/2002 Truax
6,484,825 B2 11/2002 Watson
6,510,906 B1 1/2003 Richert
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey
6,668,949 B1 12/2003 Rives
6,729,420 B2 5/2004 Mensa-Wilmot
6,732,817 B2 5/2004 Dewey
6,822,579 B2 11/2004 Goswami et al.
9,629,076 4/2005 Fanuel
6,953,096 B2 10/2005 Gledhill
2003/0213621 A1 11/2003 Britten
2004/0238221 A1 12/2004 Runia
2004/0256155 A1 12/2004 Kriesels

* cited by examiner

JACK ELEMENT ADAPTED TO ROTATE INDEPENDENT OF A DRILL BIT

This Patent Application is a continuation-in-part of U.S. patent application Ser. No. 11/611,310 filed on Dec. 15, 2006 and which is entitled System for Steering a Drill String. This Patent Application is also a continuation-in-part of U.S. patent application Ser. No. 11/278,935 filed on Apr. 6, 2006, now U.S. Pat. No. 7,426,968 and which is entitled Drill Bit Assembly with a Probe. U.S. patent application Ser. No. 11/278,935 is a continuation-in-part of U.S. patent application Ser. No. 11/277,394 which filed on Mar. 24, 2006, now U.S. Pat. No. 7,398,837 and entitled Drill Bit Assembly with a Logging Device. U.S. patent application Ser. No. 11/277,394 is a continuation-in-part of U.S. patent application Ser. No. 11/277,380 also filed on Mar. 24, 2006, now U.S. Pat. No. 7,337,858 and entitled A Drill Bit Assembly Adapted to Provide Power Downhole. U.S. patent application Ser. No. 11/277,380 is a continuation in-part of U.S. patent application Ser. No. 11/306,976 which was filed on Jan. 18, 2006, now U.S. Pat. No. 7,360,610 and entitled "Drill Bit Assembly for Directional Drilling." U.S. patent application Ser. No. 11/306,976 is a continuation in-part of Ser. No. 11/306,307 filed on Dec. 22, 2005 now U.S. Pat. No. 7,225,886, entitled Drill Bit Assembly with an Indenting Member. U.S. patent application Ser. No. 11/306,307 is a continuation in-part of U.S. patent application Ser. No. 11/306,022 filed on Dec. 14, 2005, now U.S. Pat. No. 7,198,119, entitled Hydraulic Drill Bit Assembly. U.S. patent application Ser. No. 11/306,022 is a continuation-in-part of U.S. patent application Ser. No. 11/164,391 filed on Nov. 21, 2005, now U.S. Pat. No. 7,270,196 which is entitled Drill Bit Assembly. All of these applications are herein incorporated by reference in their entirety.

BACKGROUND OF THE INVENTION

This invention relates to steering system, specifically steering system for use in oil, gas, geothermal, and/or horizontal drilling. The ability to accurately adjust the direction of drilling in downhole drilling applications is desirable to direct the borehole toward specific targets. A number of steering systems have been devised for this purpose.

One such system is disclosed in U.S. Pat. No. 5,803,185, to Barr, which is herein incorporated by reference for all that it contains. It discloses a steerable rotary drilling system with a bottom-hole assembly which includes, in addition to the drill bit, a modulated bias unit and control unit, the bias unit comprising a number of hydraulic actuators around the periphery of the unit, each having a movable thrust member which is hydraulically displaceable outwardly for engagement with the formation of the borehole being drilled. Each actuator may be connected, through a control valve, to a source of drilling fluid under pressure and the operation of the valve is controlled by the control unit so as to modulate the fluid pressure supplied to the actuators as the bias unit rotates. If the control valve is operated in synchronism with rotation of the bias unit the thrust members impart a lateral bias to the bias unit, and hence to the drill bit, to control the direction of drilling.

BRIEF SUMMARY OF THE INVENTION

In one aspect of the present invention a downhole tool string has a rotor secured within a bore and connected to a jack element that is substantially coaxial with the rotor. A portion of the jack element extends out of an opening formed in a working face of a drill bit located at the bottom of the drill string. The jack element is adapted to rotate independent of the drill bit when the rotor and drill bit are in operation.

The rotor may be part of a turbine or motor and is adapted to rotate opposite of the drill bit. In some embodiments there are may be plurality of motors or turbines used in series to rotate the rotor. The motor may be an electric motor, a hydraulic motor, or a positive displacement motor. A gear assembly, such as a planetary gear system, may connect the rotor to the jack element. The gear assembly may have a gear ratio of at least 2:1.

In some embodiments the rotation of the jack element comprises a first angular velocity and the rotation of the drill bit comprises a second angular velocity. The first and second angular velocities may be substantially equal in magnitude and opposite in direction so that during operation, the jack element rotates such that it remains substantially stationary with respect to the subterranean formation as the drill bit rotates around the jack element. The jack element may have an asymmetric distal end that is adapted to contact the formation. This is beneficial so that the substantially stationary jack element may steer the drill bit when in operation. A sensor, such as a gyroscope, may be secured to the tool string that is adapted to measure and maintain the orientation of the tool string with respect to a subterranean formation. The jack element may be part of a steering system that comprises a gyroscope and a closed loop system adapted to measure the orientation of the jack element. The closed loop system may have logic that is adapted to reorient the jack element thereby changing a direction the drill string is traveling.

In some embodiments a valve may be disposed within the bore and is adapted to direct fluid to the rotor or to bypass the rotor. It may be beneficial to direct fluid to the rotor so as to engage the rotor. However, it may be beneficial for all the fluid to bypass the rotor so that the rotor is not activated. The angular velocity of the rotor regulates the angular velocity of the jack element. In other embodiments, the rotor may have at least one magnet adapted to rotate adjacent an electrically conductive coil fixed to the rotation of the tool string. The magnet and electrically conductive coil are adapted to control the angular velocity of the rotor. This may be desired so that the angular velocity of the jack element may be regulated. The magnet may be made of samarium cobalt. The electrically conductive coil may comprise from 1.5 to 1000 windings.

DETAILED DESCRIPTION OF THE INVENTION AND THE PREFERRED EMBODIMENT

Figure 1:
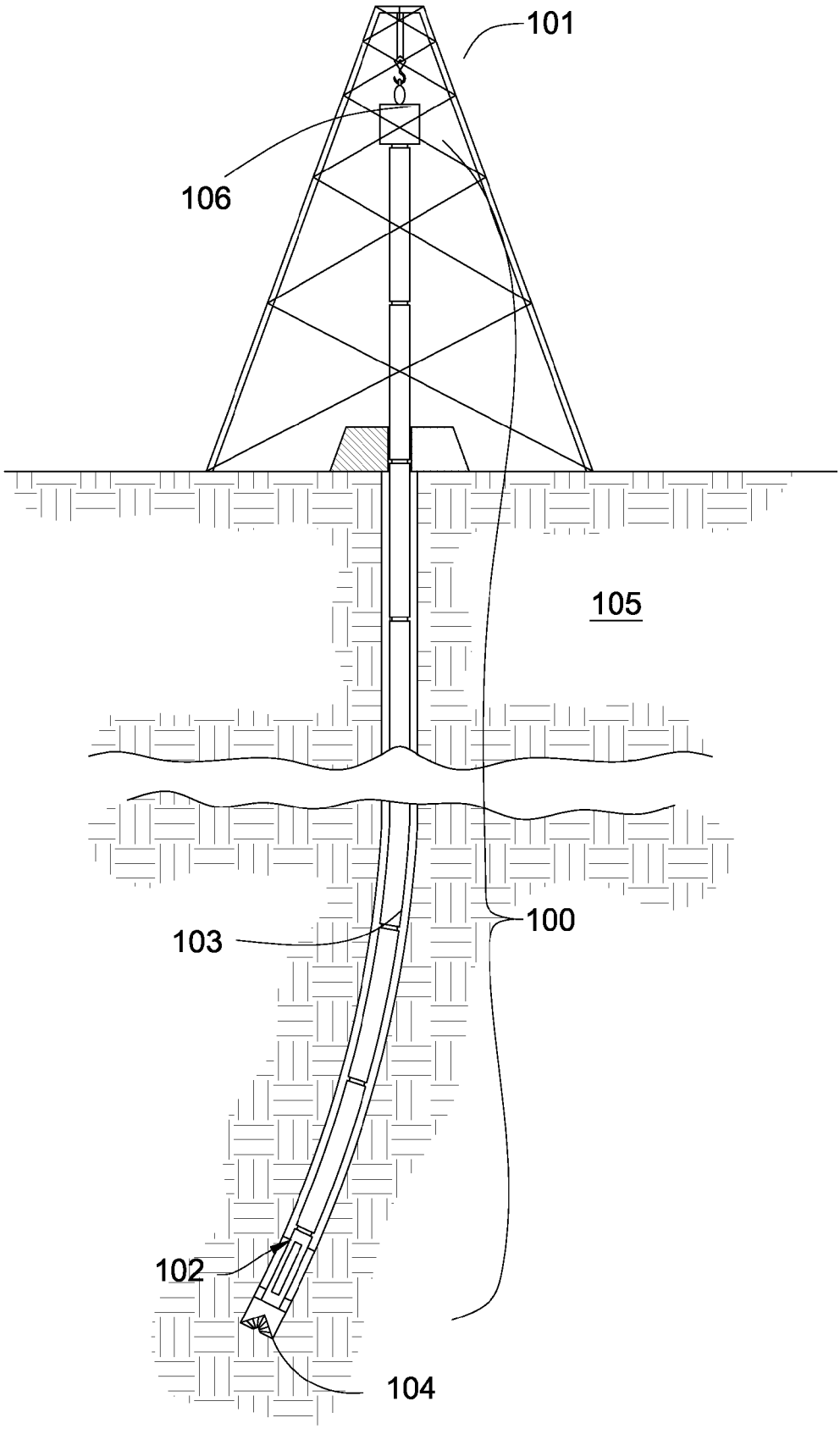
FIG. 1 is a cross-sectional diagram of an embodiment of a tool string suspended in a bore hole.

FIG. 1 is a cross-sectional diagram of an embodiment of a tool string 100 suspended by a derrick 101. A bottom-hole assembly 102 is located at the bottom of a bore hole 103 and comprises a drill bit 104. As the drill bit 104 rotates downhole the drill string 100 advances farther into the earth. The drill bit 104 may be steered in a preferred direction. The tool string 100 may penetrate soft or hard subterranean formations 105. The bottom-hole assembly 102 and/or downhole components may comprise data acquisition devices which may gather data. The data may be sent to the surface via a transmission system to a data swivel 106. The data swivel 106 may send the data to the surface equipment. Further, the surface equipment may send data and/or power to downhole tools and/or the bottom-hole assembly 102.

Figure 2:
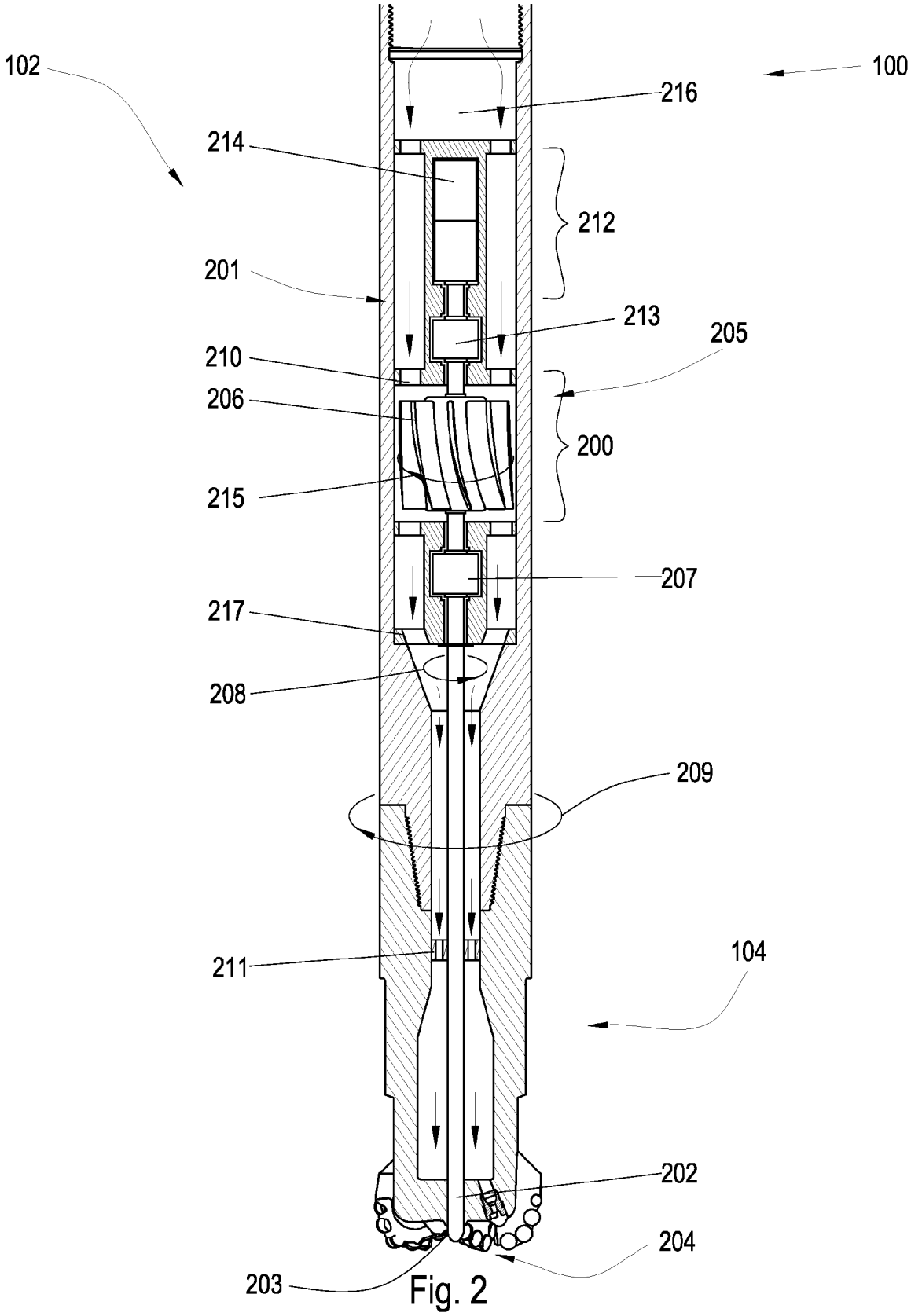
FIG. 2 is a cross-sectional diagram of an embodiment of a bottom-hole assembly.

FIG. 2 is a cross-sectional diagram of an embodiment of a bottom-hole assembly 102. A downhole tool string 100 has a rotor 200 secured within a bore 201 of the tool string 100. The rotor 200 is also connected to a jack element 202 substantially coaxial with the rotor 200. A portion of the jack element 202 extends out of an opening 203 formed in a working face 204 of a drill bit 104 located at the bottom of the tool string 100. When the rotor 200 and the drill bit 104 are in operation, the jack element 202 is adapted to rotate opposite the drill bit 104.

In the preferred embodiment, the rotor 200 is part of a turbine 205, though the rotor 200 may also be part of a motor. Preferably, the turbine 205 comprises from 3 to 10 impellers 206. The rotor 200 may be adapted to rotate opposite of the drill bit 104. A gear assembly 207 may connect the rotor 200 to the jack element 202, which may be adapted to rotate the jack opposite of the turbine or it may be adapted to rotate the jack element in the same direction The gear assembly 207 may be a planetary gear system. As drilling fluid passes through the turbine 205 in the bore 201, the impellers 206 rotate, spinning the gear assembly 207, which, in turn, spins the jack element 202. The rotation of the jack element 202 comprises a first angular velocity 208 and the rotation of the drill bit 104 comprises a second angular velocity 209. The first and second angular velocities 208, 209 may be substantially equal in magnitude and opposite in direction. When the tool string 100 is in operation the jack element 202 rotates such that it is substantially stationary with respect to the formation and the drill bit 104 rotates around the jack element 202 in an opposite direction A plurality of stator vanes 210 adjacent each of the impellers 206 may be rotationally fixed with respect to the bore of the component. The stator vanes 210 in the turbine 205 may help increase the efficiency of the turbine by redirecting the flow of the drilling fluid by preventing the fluid from flowing in a circular path down the bore 201 of the tool string 100. Stabilizers 211 disposed around the jack element 202 and within the bore 201 of the drill bit 104 may prevent buckling or decentralizing of the jack element 202.

In this embodiment, a second rotor 212 may be secured within the bore 201 of the tool string 100. A second gear assembly 213 connects the second rotor 212 to the rotor 200. The second gear assembly 213 may be adapted to rotate the second rotor 212 faster than the rotor 200. Preferably the rotors 200, 212 will have different angular velocities; preferably the second rotor 212 will rotate 1.5 to 8 times faster. The second rotor 212 may be part of an electric generator 214. One such generator 214 may be the Astro 40 from AstroFlight, Inc. The electric generator 214 comprises a stator surrounding the second rotor 212. The stator may comprise an electrically conductive coil with 1 to 50 windings. Preferably, the electrically conductive coil comprises from 1.5 to 10 windings. The electrically conductive coil may be fixed to the rotation of the tool string 100. The second rotor 212 may comprise separate magnetic strips adapted to rotate adjacent the electrically conductive coil, producing a current in the electrically conductive coil. The magnets may be made of samarium cobalt. The magnet and electrically conductive coil are adapted to control an angular velocity 215 of the rotor 200. The angular velocity 208 of the jack element 202 may be controlled by the angular velocity 215 of the rotor 200. Thus, the magnet and electrically conductive coil may be adjusted to change the angular velocity 208 of the jack element 202. This may be beneficial so that the jack element may rotate at a velocity 208 substantially equal to and opposite of the angular velocity 209 of the drill bit 104, so as to steer the tool string 100.

The electrically conductive coil may be in communication with a load. When the load is applied, power is drawn from the generator 214, slowing the rotational speed of the second rotor 212, which thereby slows the rotation of the turbine 205 and the first rotor 200. Thus, the load may be applied to control the rotation of a downhole turbine. Since the second rotor 212 rotates faster than the rotor 200, it produces less torque whereby less electrical current from the load is required to slow its rotation. Thus the second gear assembly 213 provides the advantage of reducing the electrical power requirements to control the rotation of the turbine 205. This is very beneficial since downhole power is a challenge to generate and store downhole. There may also be a second generator 216 connected to the electric generator 214 in order to create more current and/or to aid in controlling the orientation of the jack element.

Figure 8:
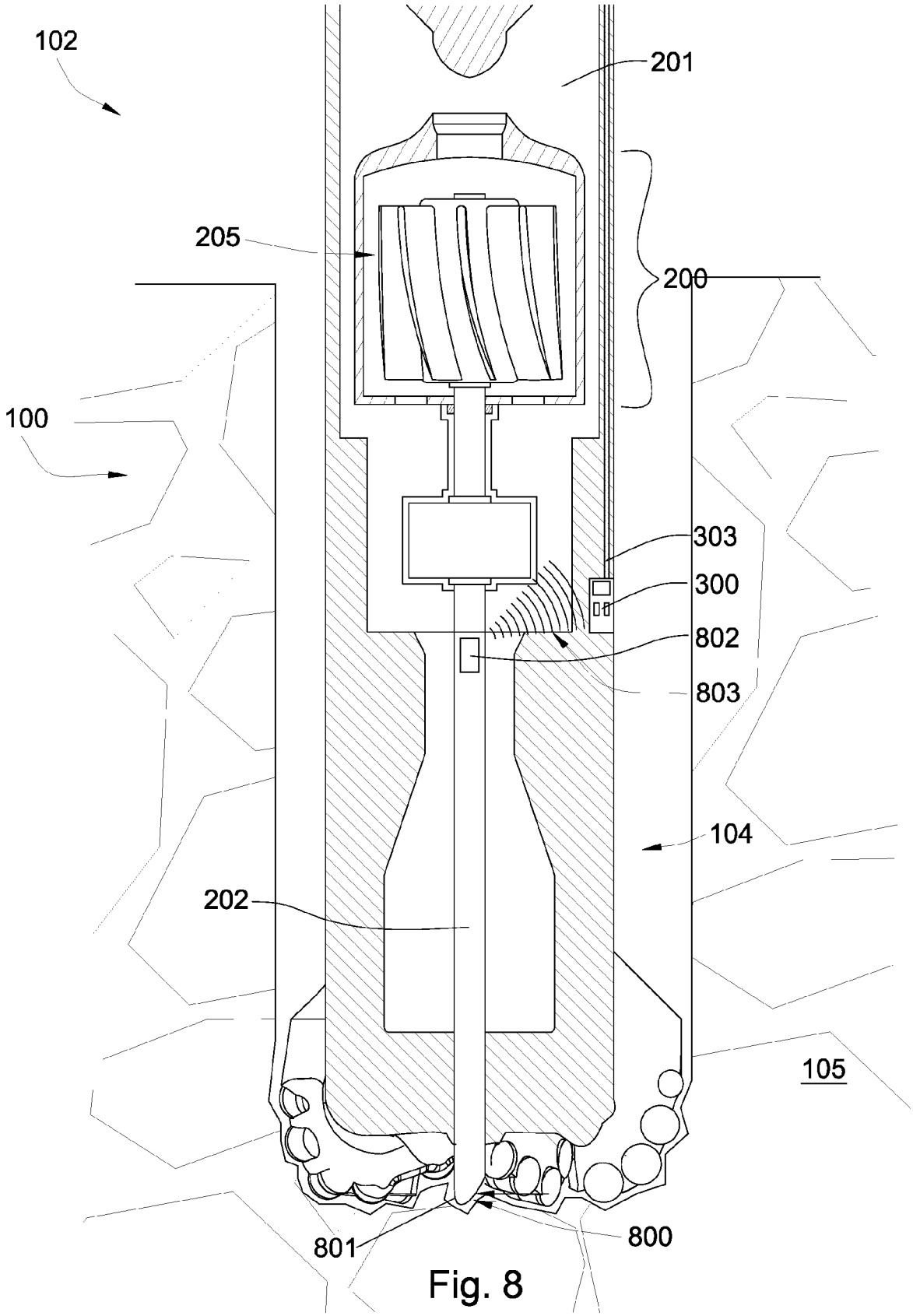
FIG. 8 is a cross-sectional diagram of another embodiment of a bottom-hole assembly.

Preferably, the jack element comprises an asymmetric distal end which biases the drill bit in a lateral direction (as shown more clearly in FIG. 8). Thus by controlling the load applied to the generator, the orientation of the distal end of the jack element may be controlled and thereby the trajectory of the drilling string may be controlled as well. In some embodiments since the jack element appears to be remaining substantially stationary with respect to the formation, the distal end may be continually biasing the drill string, in a certain direction. When a direction change is desired, the load may be applied to reorient the distal end such that it biased the drill string in another direction. In situations where it is desired to drill in a straight direction, the distal end may be continually or randomly reoriented such that the drill string travels in a substantially straight direction.

The turbine 205, gear assemblies 207, 213, and/or generators 214, 216 may be disposed within a protective casing 217 within the bore 201 of the tool string 100.

Figure 3:
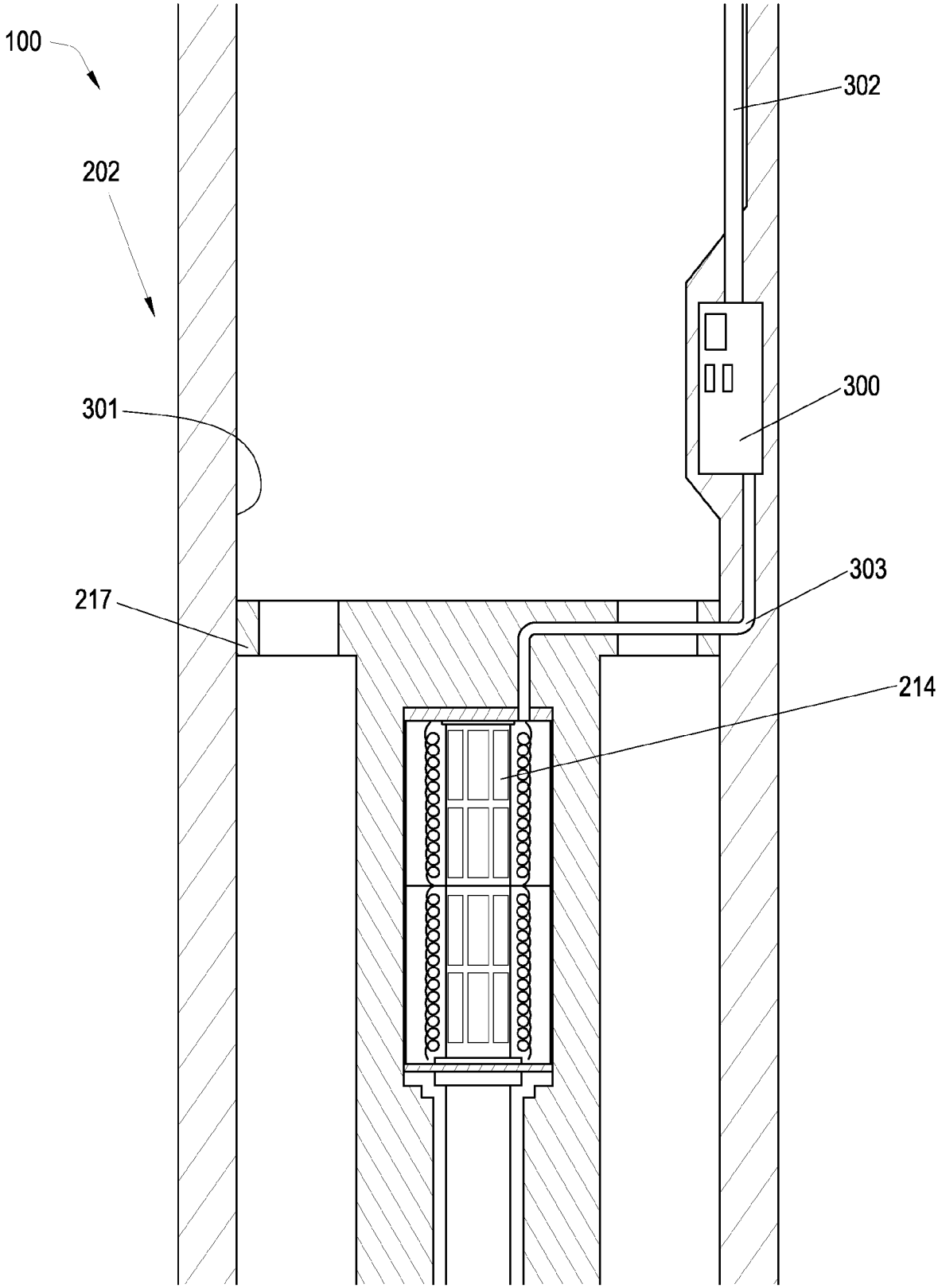
FIG. 3 is a cross-sectional diagram of an embodiment of a portion of a downhole tool string component.

FIG. 3 is a cross-sectional diagram of an embodiment of a portion of a downhole tool string component 100. The electrical generator 214 may be in communication with the load as part of an electrical circuitry 300. The electrical circuitry 300 may be disposed within the bore wall 301 of the tool string 100. The generator 214 may be connected to the electrical circuitry 300 through a cable 303. The jack element 202 may be part of a steering system comprising a gyroscope and a closed-loop system. The circuitry 300 may be part of the closed-loop system, which is adapted to measure the orientation of the jack element with respect to the tool string 100. The closed-loop system may also comprise logic adapted to reorient the jack element and thereby change a direction the tool string 100 is traveling.

The electrical circuitry 300 may also comprise at least one sensor, which may be a gyroscope, an inclinometer, or a magnetometer for monitoring various aspects of the drilling, such as the angular velocity or orientation of the tool string 100, and/or jack element with respect to the formation. The sensor, which may be a gyroscope, may also measure the speed of the first and second rotors.

The data collected from this sensor may be used to adjust the angular velocity of the turbine in order to control the jack element. The load in communication with the electrically conductive coil may also be in communication with a downhole telemetry system 302. One such system is the IntelliServ system disclosed in U.S. Pat. No. 6,670,880, which is herein incorporated by reference for all that it discloses. Data collected from the sensor or other electrical components downhole may be sent to the surface through the telemetry system 302. The data may be analyzed at the surface in order to monitor conditions downhole. Operators at the surface may use the data to alter drilling speed if the bottomhole assembly encounters formations of varying hardness. Other types of telemetry systems may include mud pulse systems, electromagnetic wave systems, inductive systems, fiber optic systems, direct connect systems, wired pipe systems, or any combinations thereof. In some embodiments, the sensor may be part of a feed back loop which controls the logic controlling the load. In such embodiments, the drilling may be automated and electrical equipment may comprise sufficient intelligence to avoid potentially harsh drilling formations while keeping the drill string on the right trajectory. In some embodiments, drilling may be fully automated where the desired trajectory and location of the pay load is programmed into the electrical equipment and allowed to run itself without the need for manual controls.

The protective casing 217 is secured to the bore wall 301 such that anything disposed within may be axially fixed with respect to the center of the bore 201. The casing 217 may comprise passages at locations where it is connected to the bore wall 301 such that the drilling fluid may be allowed to pass through.

In some embodiment of the present invention an electromagnetic brake may be used to slow the rotation of the rotor and thereby reduce the rotational velocity of the jack element. In such an embodiment, a metal disc may be secured to the rotor and electromagnets may be secured within the bore of the component, but adjacent the periphery of the disc. When the electromagnets produce a magnetic field electric currents are induced in the metal disc, which may oppose the magnetic field provided by the electromagnets, which slows the rotational velocity of the rotor.

Figure 5:
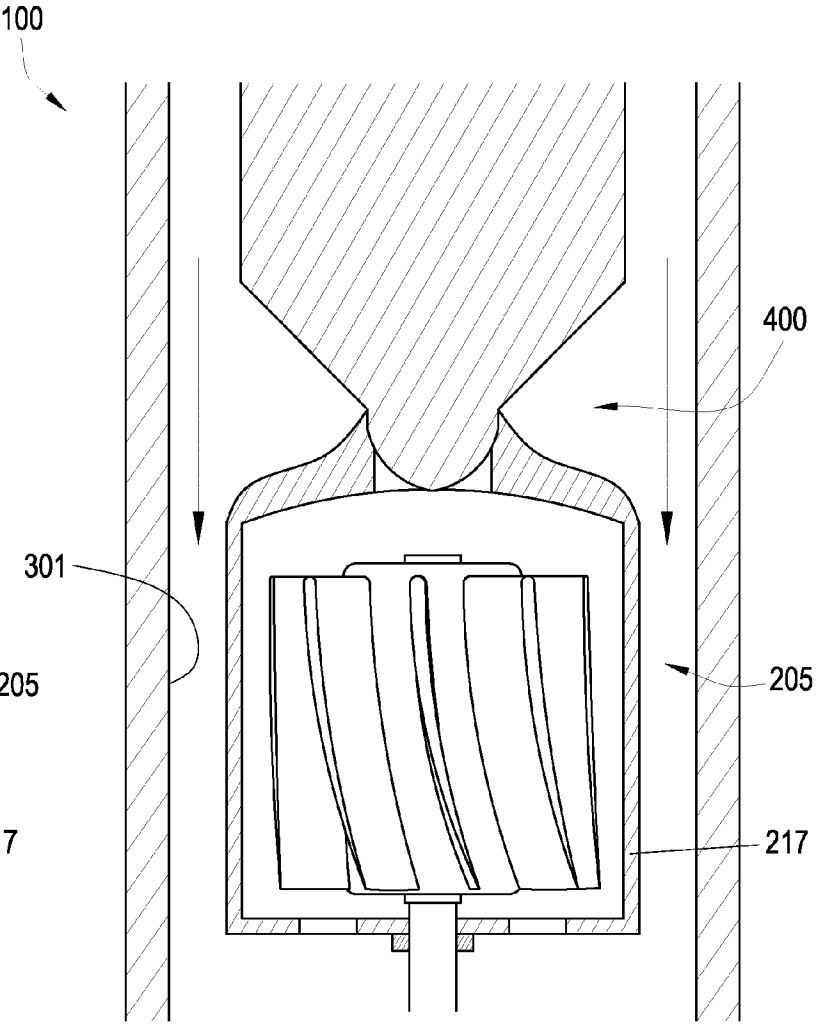
FIG. 5 is a cross-sectional diagram of another embodiment of a portion of a downhole tool string component.
Figure 4:
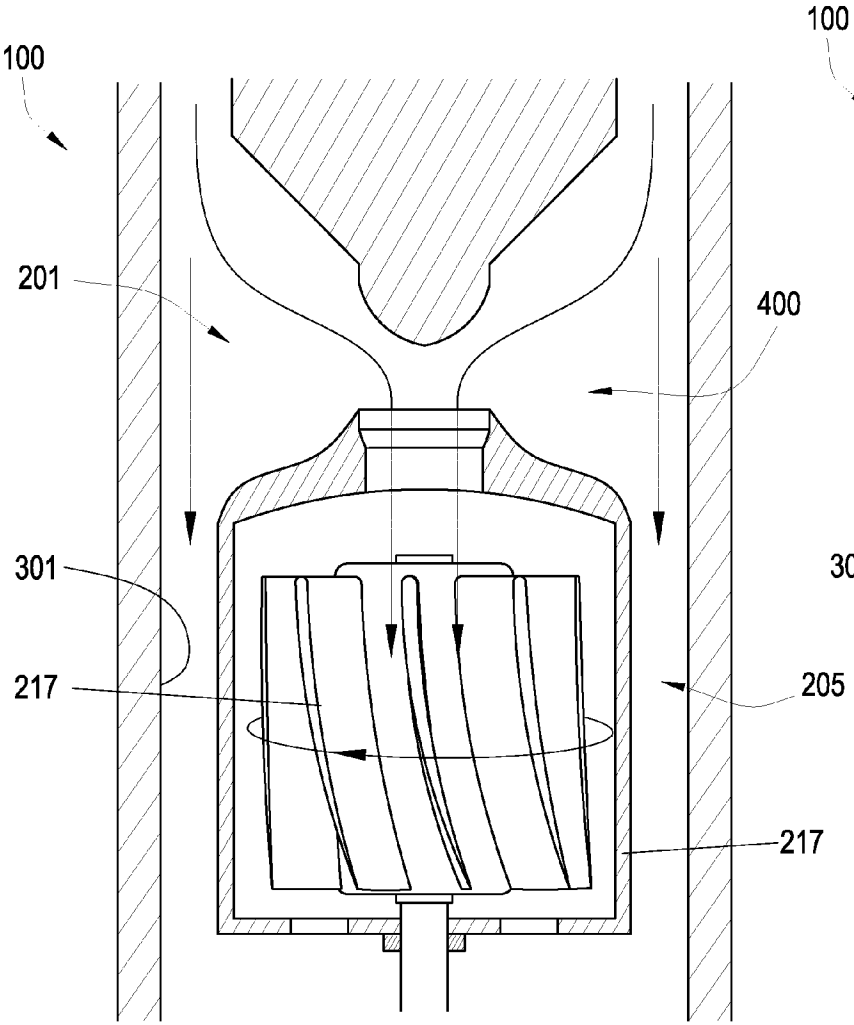
FIG. 4 is a cross-sectional diagram of another embodiment of a portion of a downhole tool string component.

FIGS. 4 and 5 are cross-sectional diagrams of other embodiments of a portion of a downhole tool string component 100 having a valve 400 that is disposed within the bore 201 and adapted to direct fluid to the turbine 205 or to bypass the turbine 205. When the valve 400 is opened, as shown in FIG. 4, a portion of the drilling fluid may pass through the turbine 205 in the bore 201, causing the impellers 206 to rotate. When the impellers 206 rotate, the gear assembly rotates the jack element. The valve 400 may be kept open when it is desired to rotate the jack element. However, if it is desired that the turbine 205 does not rotate the jack element, then the valve 400 will close as shown in FIG. 5. When the valve 400 is closed, drilling fluid cannot pass through the turbine 205 and the turbine 205 will not rotate. Drilling fluid may flow intermediate the bore wall 301 and the protective casing 217 when the valve 400 is closed. Also, the valve 400 may be adjusted so that a specified amount of fluid will flow through the turbine 205. Thus, the angular velocity of the jack element may be controlled by adjusting the valve 400 to allow a specified amount of drilling fluid to pass.

In some embodiments, there may be a second valve disposed intermediate the bore wall 301 and the protective casing 217 so that when the valve 400 is open, the second valve may close, so as to direct all the drilling fluid to pass through the turbine. This may be beneficial when it is desired to increase the angular velocity of the turbine 205 and thereby increase the angular velocity of the jack element. When the valve 400 is closed, the second valve will open so as to allow fluid to pass through the bore 201 of the tool string 100.

In some embodiments, the rotor is not activated until it is desired to change the direction that the drill string is traveling. The weight of the drill string may force the jack element to indent into the formation and remain stationary with the formation while the drill bit rotates around it. The turbine may be activated by opening the valve to allow fluid to engage its impellers. The more fluid allowed to engage the impellers the greater force will be applied to free the distal end of the jack element from the formation. Once free, the distal end of the jack may be reoriented to bias the drill string in the desired direction. Sensors may be used to monitor the torque on the jack element when freeing it from the formation. If too much torque is applied to the jack element at once and the jack element is freed to suddenly damage may result. The closed loop system may respond by slowing opening the valve so torque is built up slowly. In other embodiments, the weight on the drill string may be decreased by pulling up on the drill string, thereby reducing the amount of torque required to free the jack element.

Figure 6:
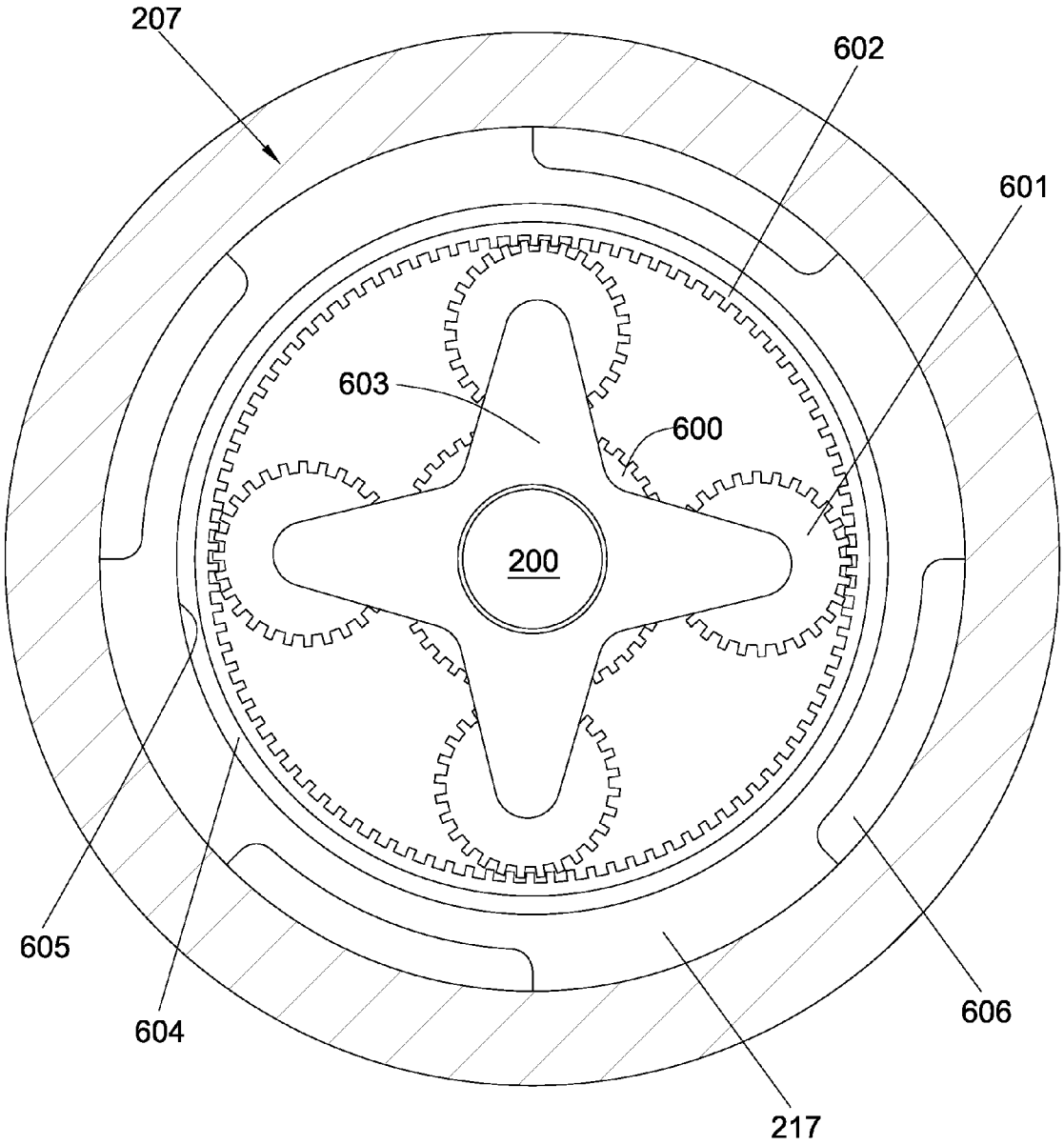
FIG. 6 is a sectional diagram of an embodiment of a gear assembly in a downhole tool string component.

FIG. 6 is a sectional diagram of an embodiment of a gear assembly 207, specifically a planetary gear system, in a downhole tool string component. The gear assembly 207 may comprise a gear ratio of at least 2:1, in some embodiments the gear ratio may be 20:1. The gear assembly 207 may be used to connect the jack element to the rotor 200. The planetary gear system comprises a central gear 600 which is turned by the rotor 200 connected to a turbine. As the central gear 600 rotates, a plurality of peripheral gears 601 surrounding and interlocking the central gear 600 rotate, which in turn cause an outer gear ring 602 to rotate. The angular velocity from the central gear 600 to the outer gear ring 602 depends on the sizes of the central gear and the plurality of peripheral gears 601. The gear assembly 207 also comprises a support member 603 for the purpose of maintaining the peripheral gears 601 axially stationary.

The planetary gear system is disposed within the casing 217 such that there is a gap 604 between the outer gear ring 602 and the casing 217 so that the gear ring 602 may rotate. The casing 217 may also comprise an inner bearing surface 605 such that the gear assembly 207 and the casing 217 may be flush with the gear ring 602 may still rotate. The protective casing 217 may also comprise a plurality of passages 606 wherein drilling fluid may pass through the bore of the tool string 100.

Figure 7:
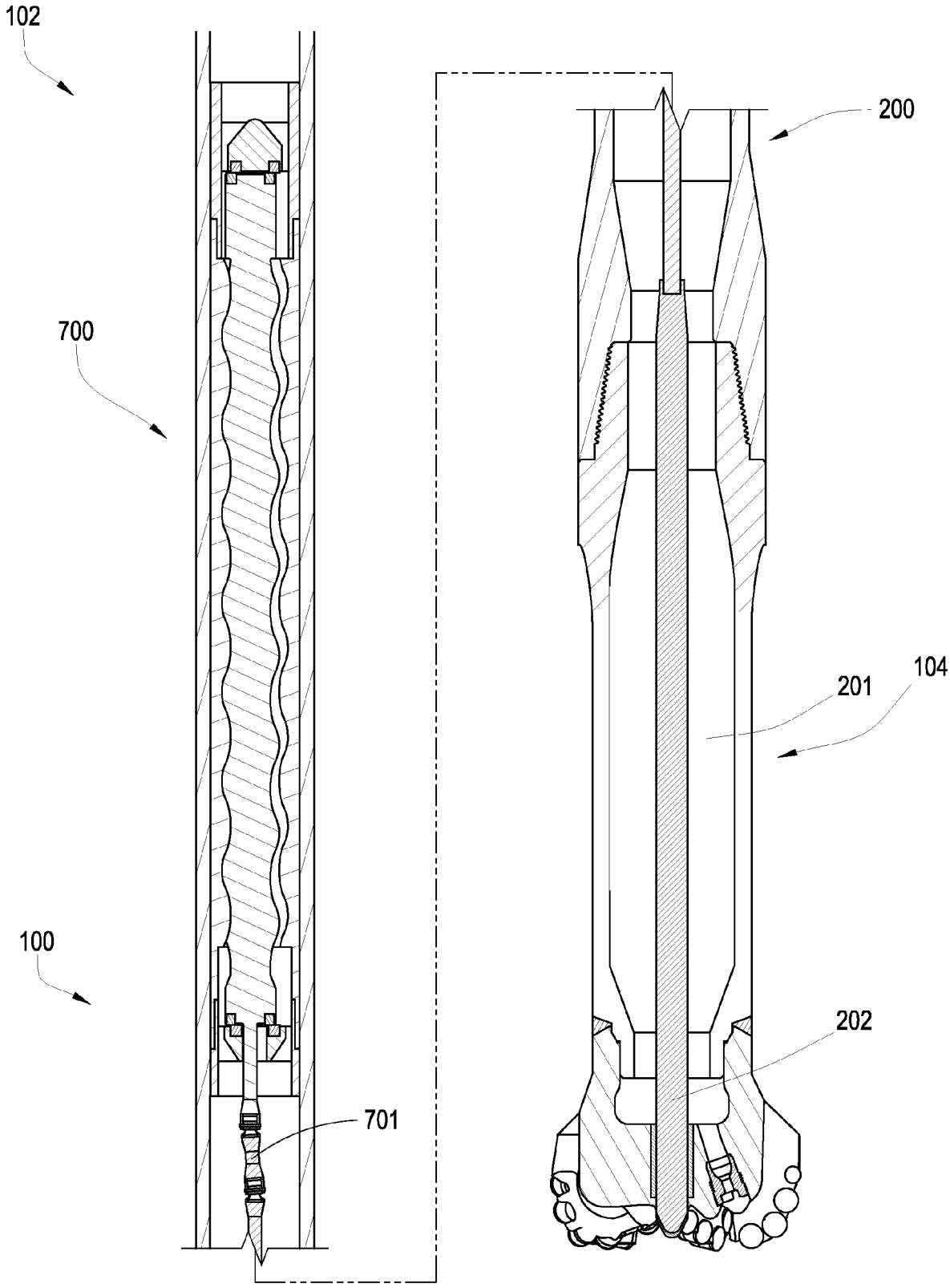
FIG. 7 is a cross-sectional diagram of another embodiment of a bottomhole assembly.

FIG. 7 is a cross-sectional diagram of another embodiment of a bottomhole assembly 102. In this embodiment, the rotor 200 is part of a motor 700. In other embodiments, the rotor 200 may be part of a turbine. Also, this embodiment depicts the motor 700 as a hydraulic motor or a positive displacement motor. However, in some embodiments, the motor 700 may be an electric motor. In this embodiment, the jack element 202 may be connected to the rotor 200 by a joint 701 such as a joint, which would allow the rotor 200 to nutate while the jack element 202 remains coaxial to the tool string 100. The rotor 200 may be adapted to rotate independent and/or opposite of the drill bit 104 such that the jack element 202 remains substantially rotationally stationary with respect to a formation, which may result in reducing bit whirl.

FIG. 8 is a cross-sectional diagram of another embodiment of a bottomhole assembly 102. A drill bit 104 comprises a rotor 200 secured within a bore 201 of a tool string 100. The rotor 200 is also connected to a jack element 202. In this embodiment, the rotor 200 is part of a turbine 205. In the preferred embodiment, the jack element 202 rotates opposite of the drill bit 104 when the rotor 200 and drill bit 104 are in operation. Also, the rotor 200 may be adapted to rotate opposite of the drill bit 104. A gear assembly, which may be a planetary gear system, may connect the rotor to the jack element 202 and may have a gear ratio of at least 2:1. The gear assembly may rotate the jack element 202 in the same direction or in the opposite direction of the rotor 200. The angular velocity of the jack element 202 and the angular velocity of the drill bit 104 are substantially equal in magnitude and opposite in direction so that during operation the jack element 202 rotates such that it is substantially stationary with respect to the formation and the drill bit 104 rotates around the jack element 202.

A portion of the jack element 202 extends out of an opening 203 formed in a working face 204 of the drill bit 104. The jack element 202 may have a distal end 800 adapted to contact a formation 105. The distal end 800 may comprise an asymmetric geometry such that one side 801 has more surface area exposed to the formation 105. The distal end 800 may be used to steer the drill bit 104 and therefore the tool string 100. The jack element 202 may also be part of a steering system that comprises a gyroscope, an inclinometer, a magnetometer, or an inclination & direction package 802 and a closed-loop system adapted to measure the orientation of the jack element 202 with respect to the tool string 100. The closed-loop system comprises logic adapted to reorient the jack element 202 and thereby change the direction the tool string 100 is traveling. The orientation of the distal end 800 may be adjusted by the logic which is in communication with a load. The gyroscope 802 may indicate the position of the distal end 800 and through a feed back loop the logic may adjust the load to reorient the distal end 800. With such a method, the complex drilling trajectories are possible. By causing the jack element 202 to rotate with the drill bit 104, the tool string 100 may drill in a generally straight direction. However, by causing the jack element 202 to rotate with an angular velocity substantially equal to and opposite an angular velocity of the drill bit 104 the jack element 202 may be substantially stationary with respect to a formation being drilled and may allow the jack element 202 to steer the tool string 100.

In some embodiments, an electrical circuitry 300 may be disposed within the bore wall 301 of the tool string 100. A generator may be connected to the electrical circuitry 300 through a coaxial cable 303. The gyroscope 802 may emit signal 803. The electrical circuitry 300 may sense the signal 803 in order to orient the jack element 202 with respect to the tool string 100. A sensor may be connected to the electrical circuitry 300 that is adapted to measure and to maintain the orientation of the tool string 100 with respect to a subterranean formation 105. The sensor may be a gyroscope, more specifically, a MEMS gyroscope, produced by MEMSense 2693D Commerce Rd. Rapid City, S. Dak. 57702. Another gyroscope that may be used is a G-2000 gyroscope produced by Northrop Gruman, located at 21240 Burbank Boulevard, Woodland Hills, Calif., 91367. The gyroscope may be used to measure angular velocity and orientation of the drill bit 104. Thus, the orientation of the tool string 100 may be adjusted through reorienting the jack element.

In some embodiments, the jack comprises a plurality of magnets spaced azimuthally along the surface of the jack. A sensor rotationally fixed to the drill bit or other drill string component of the tool drill string may sense as the magnets pass by it, thereby indicating the speed of the jack element relative to the drill bit. A gyroscope, load transducer, inclinometer, or other sensors may be secured within the drill string to indicate the orientation of the drill bit with respect to the formation.

Whereas the present invention has been described in particular relation to the drawings attached hereto, it should be understood that other and further modifications apart from those shown or suggested herein, may be made within the scope and spirit of the present invention.

What is claimed is:

1. A downhole tool string, comprising:

a rotor secured within a bore of a tool string component and connected to a jack element substantially coaxial with the rotor;

a portion of the jack element extends out of an opening formed in a working face of a drill bit located at the bottom of the tool string;

wherein the jack element is adapted to rotate independent of the drill bit when the rotor and drill bit are in operation;

wherein the jack element is part of a steering system.

2. The tool string of claim 1, wherein the rotor is part of a turbine or motor.

3. The tool string of claim 2, wherein the motor is an electric motor, a hydraulic motor, or a positive displacement motor.

4. The tool string of claim 1, wherein the rotor is adapted to rotate opposite of the drill bit.

5. The tool string of claim 1, wherein a gear assembly connects the rotor to the jack element.

6. The tool string of claim 5, wherein the gear assembly is a planetary gear system.

7. The tool string of claim 5, wherein the gear assembly comprises a gear ratio of at least 2:1.

8. The tool string of claim 1, wherein a sensor is secured to the tool string adapted to measure and to maintain the orientation of the tool string with respect to a subterranean formation.

9. The tool string of claim 8, wherein the sensor is a gyroscope, an inclinometer, a magnetometer or combinations thereof.

10. The tool string of claim 1, wherein a valve is disposed within the bore and adapted to direct fluid to the rotor or to bypass the rotor.

11. The tool string of claim 1, wherein the rotation of the jack element comprises a first angular velocity and the rotation of the drill bit comprises a second angular velocity, wherein the first and second angular velocities are substantially equal in magnitude and opposite in direction.

12. The tool string of claim 1, wherein during operation the jack element rotates such that it is substantially stationary with respect to the subterranean formation and the drill bit rotates around the jack element.

13. The tool string of claim 1, wherein the jack element comprises a distal end adapted to contact the formation which comprises an asymmetric geometry.

14. The tool string of claim 1, wherein the steering system comprises a gyroscope and a closed-loop system adapted to measure the orientation of the jack element.

15. The tool string of claim 14, wherein the closed-loop system comprises logic adapted to reorient the jack element and thereby change a direction the tool string is traveling.

16. The tool string of claim 1, wherein the rotor comprises at least one magnet adapted to rotate adjacent an electrically conductive coil fixed to the rotation of the tool string; wherein the magnet and electrically conductive coil are adapted to control the angular velocity of the rotor.

17. The tool string of claim 16, wherein the magnet is made of samarium cobalt.

18. The tool string of claim 16, wherein the electrically conductive coil comprises from 1.5 to 10 windings.

19. The tool string of claim 1, wherein the jack element is adapted to rotate opposite of the drill bit when the rotor and drill bit are in operation.

* * * * *